US007147298B2

(12) United States Patent
Usuda

(10) Patent No.: US 7,147,298 B2
(45) Date of Patent: Dec. 12, 2006

(54) SYSTEM AND METHODS FOR PROVIDING AN ORGANIC ELECTROLUMINESCENT DEVICE

(75) Inventor: Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/377,626

(22) Filed: Mar. 4, 2003

(65) Prior Publication Data

US 2003/0227509 A1 Dec. 11, 2003

(30) Foreign Application Priority Data

Mar. 4, 2002 (JP) ..... 2002-058068

(51) Int. Cl.
*B41J 2/165* (2006.01)

(52) U.S. Cl. ..... 347/35; 347/36; 347/24; 347/20

(58) Field of Classification Search ..... 347/24, 347/26, 29, 35, 36, 40, 41, 12, 42, 20
See application file for complete search history.

(56) References Cited

U.S. PATENT DOCUMENTS 6,390,597 B1 * 5/2002 Fujimoto et al. ..... 347/40
2001/0020962 A1 * 9/2001 Kanaya et al. ..... 347/24
2002/0005873 A1 * 1/2002 Suzuki ..... 347/27

* cited by examiner

*Primary Examiner*—Hai Pham
*Assistant Examiner*—Lam Nguyen
(74) *Attorney, Agent, or Firm*—Oliff & Berridge, PLC

(57) ABSTRACT

The present invention provides a liquid drop discharge apparatus capable of flushing in which the adverse effect on film deposition and patterning and the contamination of the apparatus are prevented without impairing productivity and a driving method of the same, an apparatus and a method for film deposition are provided. The liquid drop discharge apparatus can include a liquid drop discharge head configured to reciprocate in the X-axis direction with a plurality of nozzles arranged lengthwise and crosswise, a flushing area disposed on at least one side of a substrate on a stage, and a control device for controlling an operation by the liquid drop discharge head, in which the liquid drop discharge head is disposed obliquely toward the X-axis direction. The control device control the liquid drop discharge head to perform a flushing operation inside the flushing area while moving it, and the control device can control the entire nozzles to stop the flushing operation when at least one nozzle reaches the position outside the predetermined flushing area.

17 Claims, 15 Drawing Sheets

SYSTEM AND METHODS FOR PROVIDING AN ORGANIC ELECTROLUMINESCENT DEVICE

BACKGROUND OF THE INVENTION

1. Field of Invention

The invention relates to a liquid drop discharge apparatus for applying liquid drops onto a substrate placed on a stage, more specifically to a liquid drop discharge apparatus having a mechanism of controlling its flushing operation and a driving method of the same, further an apparatus and a method for film deposition, a method for forming a color filter, a method for fabricating an organic electroluminescent device, and an electronic device.

2. Description of Related Art

As a liquid drop discharge apparatus for discharging liquid drops of ink and the like for thin film deposition and patterning, there is an apparatus to which inkjet techniques is applied in general. This apparatus has a liquid drop discharge head for receiving the feed of a liquid material from a liquid material feeding part and a stage for relatively moving a substrate to the liquid drop discharge head, which allows liquid drops to be discharged onto the substrate while moving the liquid drop discharge head based on discharge data for thin film deposition and patterning.

In such a device, the liquid drop discharge head can be mounted on a carriage disposed on the stage to be movable to the stage in the X-direction, for example. In addition, the stage is provided with a transport mechanism for transporting the substrate in the Y-direction, for example. Therefore, the liquid drop discharge head is relatively movable in the X- and Y-direction to the substrate.

Furthermore, the liquid drop discharge head can be a rectangle in a plane, in which multiple nozzles for discharging liquid drops onto the substrate are arranged lengthwise and crosswise, such as in a matrix or array. A shaft for supporting the liquid drop discharge head is disposed rotatably by a rotating unit, which allows discharging liquid drops in the position that the rows of nozzles are oblique toward the X-direction and the Y-direction. Here, setting the rows of the nozzles oblique for discharging liquid drops is that the pitch between the adjacent nozzles constantly formed is virtually narrowed to conduct fine, or continuous thin film deposition and patterning.

More specifically, as shown in FIG. 15(*a*), when liquid drops are discharged in the normal position that rows L of nozzles N of a liquid drop discharge head H are orthogonal to the direction of moving them (the X-direction), the pitch P2 between the liquid drops T to be discharged becomes equal to the pitch P1 between the nozzles N and N.

On the other hand, as shown in FIG. 15(*b*), when liquid drops are discharged in the position that the rows L of the nozzles N of the liquid drop discharge head H are set oblique toward the direction of moving them (the X-direction), the pitch P3 between the liquid drops T to be discharged becomes narrower than the pitch P1 between the nozzles N and N. Consequently, the pitch between the nozzles can be virtually narrowed.

In the meantime, in this apparatus, when the volatility of a solvent in a liquid material to be discharged is particularly high, nozzles not continuously discharging the liquid material cause an increase in viscosity in the liquid material held in the openings due to the volatilized solvent. In the extreme case, there have been problems that the liquid material is set, dust and dirt are attached here, or air bubbles are mixed, which generate clogging in the nozzle openings to cause discharge failures.

SUMMARY OF THE INVENTION

To prevent these discharge failures, a flushing area is traditionally disposed on one side or both sides of the stage. This flushing area is a place where the separate nozzles of the liquid drop discharge head are forced to discharge, which is disposed particularly for the nozzles that have not discharged for a relatively long time to prevent discharge failures. However, flushing in the flushing area has the following problems to be improved.

Generally, in the flushing area, the movement of the liquid drop discharge head is temporarily stopped to the stage (substrate), and flushing is performed in this state. However, when the movement of the liquid drop discharge head is stopped to perform flushing in this manner, time for the entire processes of thin film deposition and patterning by discharge is prolonged. Consequently, productivity of the device can be impaired.

In addition, to eliminate this problem, it can be considered to perform flushing in the flushing area as the liquid drop discharge head is moved. However, particularly in the case of disposing the liquid drop discharge head obliquely, a part of nozzles tends to protrude from the flushing area. At this time, when the protruded nozzles are allowed to flush, liquid drops scatter around to smear the area. Then, film deposition and patterning to be the object are adversely affected, or the apparatus itself is contaminated to complicate maintenance.

The invention has been made in view of the circumstances. The object is to provide a liquid drop discharge apparatus capable of flushing in which the adverse effect on film deposition and patterning and the contamination of the apparatus are prevented without impairing productivity and a driving method of the same, further an apparatus and a method for film deposition, a method for forming a color filter, a method for fabricating an organic electroluminescent device, and an electronic device.

In order to achieve the object, a liquid drop discharge apparatus of the invention can include a liquid drop discharge head disposed above a stage and configured to reciprocate in one direction with respect to a substrate with a plurality of nozzles arranged lengthwise and crosswise for discharging a liquid drop onto the substrate, a flushing area disposed on at least one side of the substrate on the stage in the direction, and a control unit adapted to control an operation by the liquid drop discharge head. The liquid drop discharge head has rows of the nozzles disposed obliquely toward the direction, in which the control unit controls the liquid drop discharge head to perform a flushing operation inside the flushing area while moving the liquid drop discharge head, and the control unit controls the entire nozzles to stop the flushing operation when at least one nozzle reaches a position outside a predetermined flushing area.

According to the liquid drop discharge apparatus, the flushing operation can be performed inside the flushing area while moving the liquid drop discharge head. Therefore, productivity is not impaired by this flushing. In addition, the control unit was configured to stop the flushing operation by the entire nozzles when at least one nozzle reached the position outside the predetermined flushing area. Thus, the adverse effect on film deposition and patterning and the contamination of the apparatus due to the nozzle protruding from the flushing area to flush can be prevented.

Another liquid drop discharge apparatus of the invention can include a liquid drop discharge head disposed above a stage and configured to reciprocate in one direction with respect to a substrate with a plurality of nozzles arranged lengthwise and crosswise for discharging a liquid drop onto the substrate, a flushing area disposed on at least one side of the substrate on the stage in the direction, and a control unit adapted to control an operation by the liquid drop discharge head. The liquid drop discharge head has rows of the nozzles disposed obliquely toward the direction, in which the control unit controls the liquid drop discharge head to perform a flushing operation inside the flushing area while moving the liquid drop discharge head, and the control unit controls a nozzle to stop the flushing operation when the nozzle reaches a position outside a predetermined flushing area.

According to the liquid drop discharge apparatus, the flushing operation can be performed inside the flushing area while moving the liquid drop discharge head. Therefore, productivity is not impaired by this flushing. Furthermore, the control unit was configured to stop the flushing operation by the nozzle when the nozzle reached the position outside the predetermined flushing area. Thus, the adverse effect on film deposition and patterning and the contamination of the apparatus due to the nozzle protruding from the flushing area to flush can be prevented.

In addition, in the liquid drop discharge apparatus, the control unit preferably controls the nozzle to stop the flushing operation, and then controls the nozzle to perform a microvibration operation.

Accordingly, an increase in viscosity due to a volatilized solvent contained in the liquid inside the liquid drop discharge head can be prevented more surely. Furthermore, in the liquid drop discharge apparatus, the flushing area is preferably disposed on both sides of the substrate on the stage in the direction. Therefore, flushing can be performed on both sides when the head reciprocates in the direction, and thus an increase in viscosity due to the volatilized solvent contained in the liquid inside the liquid drop discharge head can be prevented more surely.

Moreover, in the liquid drop discharge apparatus, the control unit preferably controls the liquid drop discharge head to perform the flushing operation only when the head is moved over the flushing area toward the inside, not allowing the flushing operation when the head is moved over the flushing area toward the outside.

Accordingly, the flushing operation can be performed only when the head is moved toward the inside, that is, toward the substrate side. Thus, the nozzles flush right before discharging liquid drops onto the substrate, and the discharge failure of the nozzles can be prevented more effectively. Additionally, the flushing operation is not performed when the head is moved toward the outside, and therefore the liquid to be wasted can be reduced.

Besides, in the liquid drop discharge apparatus, the liquid drop discharge head is preferably disposed rotatably in its circumferential direction, and its rotation is controlled by the control unit, and the control unit controls the liquid drop discharge head to rotate beforehand so that the rows of the nozzles are orthogonal to the direction when the liquid drop discharge head is moved into the flushing area to flush, and the control unit controls it to rotate obliquely again after the entire nozzles stop the flushing operation. Therefore, the liquid drop discharge head is rotated so that the rows of the nozzles are orthogonal to the direction, and flushing is performed in this state. Thus, it can be prevented that the liquid drop discharge head obliquely disposed causes a part of the nozzles to protrude from the flushing area and the nozzles flush in this state.

In addition, when it is done, the operation of rotating the liquid drop discharge head in which the rows of the nozzles are orthogonal to the direction is preferably performed over the flushing area. Accordingly, flushing can be performed without affecting discharging liquid drops onto the substrate.

A film deposition apparatus of the invention is characterized by having the liquid drop discharge apparatus.

According to the film deposition apparatus, it can have the liquid drop discharge apparatus. Thus, productivity is not impaired by flushing, and the adverse effect on film deposition and the contamination of the apparatus due to the nozzle protruding from the flushing area to flush can be prevented.

A driving method of a liquid drop discharge apparatus of the invention is characterized in that the liquid drop discharge apparatus having a liquid drop discharge head disposed above a stage and configured to reciprocate in one direction with respect to a substrate with a plurality of nozzles arranged lengthwise and crosswise for discharging a liquid drop onto the substrate, a flushing area disposed on at least one side of the substrate on the stage in the direction. The liquid drop discharge head has rows of the nozzles disposed obliquely toward the direction. The method can include flushing in which the liquid drop discharge head is allowed to perform a flushing operation inside the flushing area while moving the liquid drop discharge head, and after that, the entire nozzles are allowed to stop the flushing operation when at least one nozzle reaches a position outside a predetermined flushing area.

According to the driving method of the liquid drop discharge apparatus, the flushing operation is performed inside the flushing area while moving the liquid drop discharge head. Therefore, productivity is not impaired by this flushing. Furthermore, the entire nozzles are allowed to stop the flushing operation when at least one nozzle reaches the position outside the predetermined flushing area. Thus, the adverse effect on film deposition and patterning and the contamination of the apparatus due to the nozzle protruding from the flushing area to flush can be prevented.

Another driving method of the liquid drop discharge apparatus of the invention is characterized in that the liquid drop discharge apparatus can include a liquid drop discharge head disposed above a stage and configured to reciprocate in one direction with respect to a substrate with a plurality of nozzles arranged lengthwise and crosswise for discharging a liquid drop onto the substrate, and a flushing area disposed on at least one side of the substrate on the stage in the direction. The liquid drop discharge head has rows of the nozzles disposed obliquely toward the direction. The method can include flushing in which the liquid drop discharge head is allowed to perform the flushing operation inside the flushing area while moving the liquid drop discharge head, and after that, a nozzle is allowed to stop the flushing operation when the nozzle reaches the position outside a predetermined flushing area.

According to the driving method of the liquid drop discharge apparatus, the flushing operation is performed inside the flushing area while moving the liquid drop discharge head. Therefore, productivity is not impaired by this flushing. Moreover, the nozzle is allowed to stop the flushing operation when the nozzle reaches the position outside the predetermined flushing area. Thus, the adverse effect on film deposition and patterning and the contamination of the apparatus due to the nozzle protruding from the flushing area to flush can be prevented.

In addition, in the driving method of the liquid drop discharge apparatus, the nozzle is preferably controlled to stop the flushing operation, and then the nozzle is allowed to perform a microvibration operation. Accordingly, an increase in viscosity due to a volatilized solvent contained in the liquid inside the liquid drop discharge head can be prevented more surely. Furthermore, in the driving method of the liquid drop discharge apparatus, the flushing area is preferably disposed on both sides of the substrate on the stage in the direction. Therefore, flushing is performed on both sides when the head reciprocates in the direction. Thus, an increase in viscosity due to a volatilized solvent contained in the liquid inside the liquid drop discharge head can be prevented more surely.

Moreover, in the driving method of the liquid drop discharge apparatus, the liquid drop discharge head is preferably allowed to perform the flushing operation only when it is moved over the flushing area toward the inside, not allowing the flushing operation when it is moved over the flushing area toward the outside.

Accordingly, the flushing operation is performed only when the head is moved toward the inside, that is, the substrate side. Therefore, the nozzles flush right before discharging liquid drops onto the substrate, and the discharge failure of the nozzles can be prevented more effectively. Moreover, the flushing operation is not performed when the head is moved toward the outside, and thus the liquid to be wasted can be reduced.

Besides, in the driving method of the liquid drop discharge apparatus, the liquid drop discharge head can preferably be disposed rotatably in its circumferential direction, and the rotation is controlled by the control unit, and the control unit controls the liquid drop discharge head to rotate beforehand so that the rows of the nozzles are orthogonal to the direction when the liquid drop discharge head is moved into the flushing area to flush, and the control unit controls it to rotate obliquely again after the entire nozzles stop the flushing operation.

Therefore, the liquid drop discharge head is rotated so that the rows of the nozzles are orthogonal to the direction and flushing is performed in this state. Thus, it can be prevented that the obliquely disposed liquid drop discharge head causes a part of the nozzles to protrude from the flushing area and flushing is performed in this state.

Additionally, when it is done, the operation of rotating the liquid drop discharge head in which the rows of the nozzles are orthogonal to the direction is preferably performed over the flushing area. Accordingly, flushing can be performed without affecting discharging liquid drops onto the substrate.

A film deposition method of the invention can be characterized by having the driving method of the liquid drop discharge apparatus.

According to the film deposition method, it has the driving method of the liquid drop discharge apparatus. Therefore, productivity is not impaired by flushing, and the adverse effect on film deposition and the contamination of the apparatus due to the nozzle protruding from the flushing area to flush can be prevented.

A method for forming a color filter of the invention can be characterized by forming the color filter by the film deposition method.

According to the method for forming the color filter, productivity is not impaired as described above, and the color filter can be formed superiorly with excellent productivity because the adverse effect on film deposition and the contamination of the apparatus can be prevented.

A method for fabricating an organic electroluminescent device of the invention is characterized by forming a thin film to be a component of the organic electroluminescent device by the film deposition method. According to the method for fabricating the organic electroluminescent device, productivity is not impaired as described above, and the thin film to be the component of the organic electroluminescent diode can be fabricated superiorly with excellent productivity because the adverse effect on film deposition and the contamination of the apparatus can be prevented.

An electronic device of the invention can be characterized by having a device fabricated by the film deposition method. According to the electronic device, it has the device fabricated by using the film deposition method, and thus the electronic device is fabricated superiorly with excellent productivity.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

Figure 1:
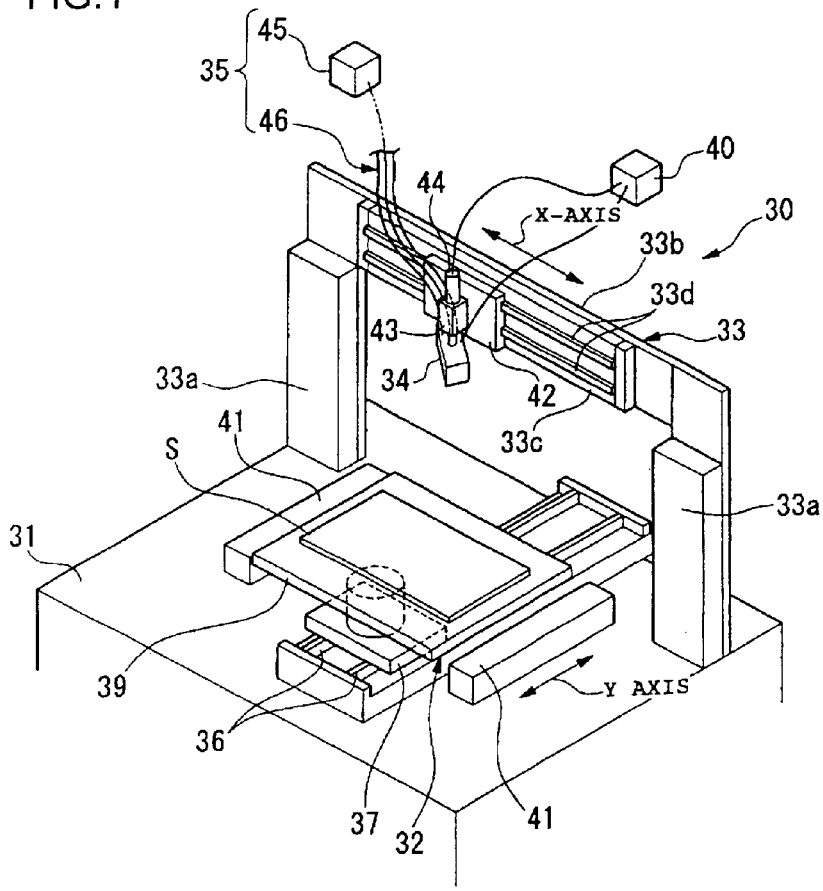
FIG. 1 is a perspective view depicting the schematic configuration of one exemplary embodiment of a liquid drop discharge apparatus of the invention.

FIG. 1 is a diagram illustrating one exemplary embodiment in the case where a film deposition apparatus provided with a liquid drop discharge apparatus of the invention is used as an apparatus for forming a color filter. In FIG. 1, a numeral 30 denotes the liquid drop discharge apparatus to be the film deposition apparatus. The liquid drop discharge apparatus 30 is configured to have a base 31, a substrate transfer unit 32, a head transfer unit 33, a liquid drop discharge head 34, a liquid feeding unit 35, and a control device (control unit) 40 or the like. The base 31 has the substrate transfer unit 32 thereon and the head transfer unit 33.

The substrate transfer unit 32 is disposed over the base 31, which has guide rails 36 disposed along the Y-axis direction. The substrate transfer unit 32 is configured to move a slider 37 along the guide rails 36 by a linear motor (not shown), for example.

A stage 39 is fixed over the slider 37. The stage 39 is for positioning and holding a substrate S. That is, the stage 39 can include a vacuum chuck unit (not shown) in which the vacuum chuck unit is operated to vacuum and hold the substrate S on the stage 39. The substrate S is accurately positioned and held at a predetermined position on the stage 39 by a positioning pin (not shown) on the stage 39.

On both sides of the substrate S on the stage 39, that is, on both sides of the liquid drop discharge head 34 in the moving direction (X-axis direction), which will be described later, a flushing area 41 for allowing the liquid drop discharge head 34 to flush is disposed. The flushing areas 41 are a rectangle in a plane formed to extend in the Y-axis direction, the flushing areas 41 are formed of opening parts of containers disposed on the base 31 on the sides of the stage 39. In addition, the positions of the flushing areas 41 and 41 are predetermined on the base 31, and the positions are stored in the control device, which will be described in greater detail below.

The head transfer unit 33 has a pair of stands 33*a* and 33*a* erected on the rear side of the base 31, and a rail area 33*b* disposed above the stands 33*a* and 33*a*, in which the rail area 33*b* is disposed in the X-axis direction, that is, disposed along the direction orthogonal to the Y-axis direction of the substrate transfer unit 32. The rail area 33*b* is formed to have a retainer plate 33*c* between the stand 33*a* and 33*a*, and a pair of guide rails 33*d* and 33*d* disposed on the retainer plate 33*c*, in which a carriage 42 for mounting the liquid drop discharge head 34 is held movably in the length direction of the guide rails 33*d* and 33*d*. The carriage 42 runs on the guide rails 33*d* and 33*d* by operating a linear motor (not shown) or the like to move the liquid drop discharge head 34 in the X-axis direction.

Here, the carriage 42 is movable in the length direction of the guide rails 33*d*, that is, movable in the X-axis direction in a unit of micrometer, for example. The movement is controlled by the control device 40. Therefore, the positions of the flushing areas 41 and 41 are stored in the control device 40 as described before. Thus, the relationship between the respective operations of the liquid drop discharge head 34 and the positions of the flushing areas 41 can be controlled by the control device 40 as described later.

The liquid drop discharge head 34 is rotatably mounted on the carriage 42 through an attachment 43. The attachment 43 is disposed with a motor 44. The liquid drop discharge head 34 has a support shaft (not shown) joined to the motor 44. According to the configuration, the liquid drop discharge head 34 is rotatable in its circumferential direction. Furthermore, the motor 44 is also connected to the control device 40. Therefore, the control device 40 controls the liquid drop discharge head 34 to rotate in the circumferential direction.

Figure 2A:
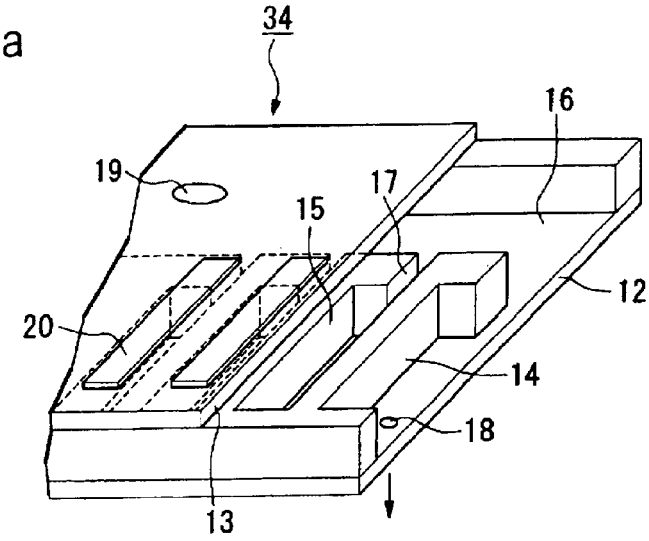
FIG. 2 is a diagram for illustrating the schematic configuration of a liquid drop discharge head, (a) illustrates a perspective view of the essential part, and (b) illustrates a cross sectional view of the essential part.
Figure 2B:
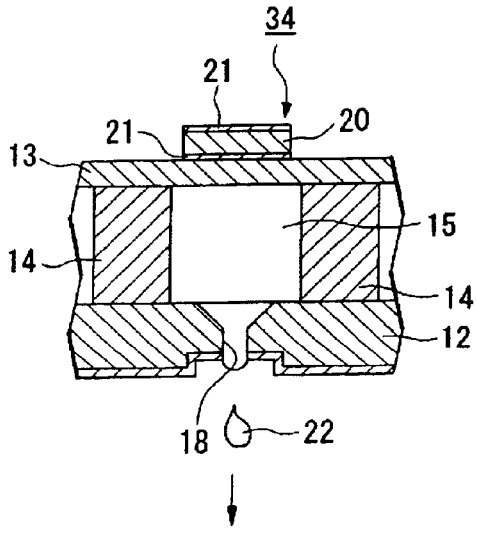

Here, as shown in FIG. 2(*a*), the liquid drop discharge head 34 has a nozzle plate 12 made of stainless steel and a diaphragm 13, in which both are joined through a partition member (reservoir plate) 14. Between the nozzle plate 12 and the diaphragm 13, the partition member 14 forms a plurality of spaces 15 and a reservoir 16. The inside of the spaces 15 and the reservoir 16 is filled with a liquid material, and the spaces 15 are communicated with the reservoir 16 through feed openings 17. Moreover, the nozzle plate 12 is formed with a plurality of nozzle openings 18 for producing a jet of the liquid material from the spaces 15, the nozzle openings are arranged lengthwise and crosswise. Additionally, an opening 19 for feeding the liquid material to the reservoir 16 is formed in the diaphragm 13.

Furthermore, as shown in FIG. 2(*b*), a piezoelectric element 20 is joined on the surface of the diaphragm 13 opposite to the surface facing the space 15. The piezoelectric element 20 is positioned between a pair of electrodes 21, which is configured to project and bend to the outer side when conducted. Then, according to the configuration, the diaphragm 13 joined with the piezoelectric element 20 bends to the outer side integrated with the piezoelectric element 20 simultaneously. Thus, the capacity of the space 15 is increased. Therefore, the liquid material equivalent to the increased capacity inside the space 15 flows in from the reservoir 16 through the feed opening 17. In addition, when current carrying to the piezoelectric element 20 is stopped from this state, the piezoelectric element 20 and the diaphragm 13 return into the original shapes. Consequently, the space 15 returns to have the original capacity, and the pressure of the liquid material inside the space 15 is increased to discharge a liquid drop 22 of the liquid material onto the substrate from the nozzle opening 18.

Figure 15A:
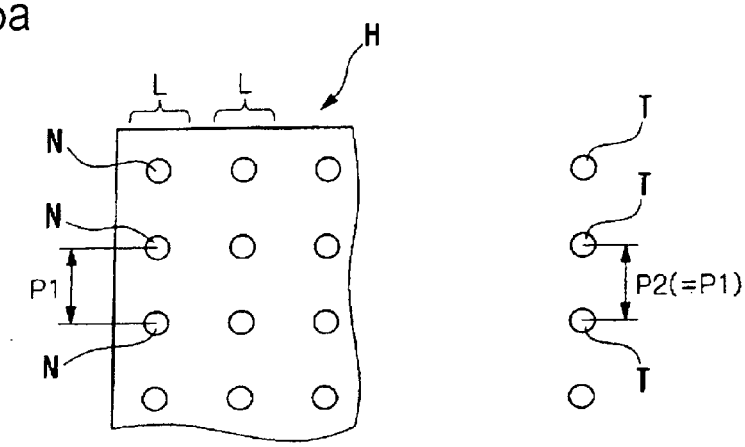
FIGS. 15(*a*) and (*b*) are diagrams for illustrating the relationship between the position of the liquid drop discharge head (mounting angle) and liquid drops to be discharged.
Figure 15B:
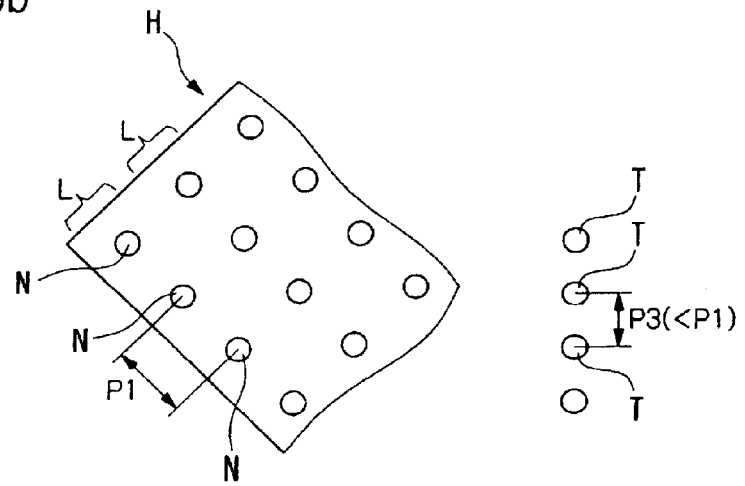

Moreover, in the liquid drop discharge head 34 formed of this configuration, the bottom shape is nearly rectangular. As shown in FIGS. 15(*a*) and 15(*b*), the nozzles N (nozzle openings 18) are arranged lengthwise and crosswise in a rectangular shape. Then, in the embodiment, a group of nozzles arranged lengthwise, that is, arranged in the long side direction is formed to be a row of nozzles (nozzle row). Besides, the piezoelectric element 20 is independently disposed for each of the nozzles N (nozzle openings 18). Thus, the discharge operation and the microvibration operation, which will be described later, are conducted independently.

The liquid feeding unit 35 is formed of a liquid feeding source 45 for feeding the liquid material to the liquid drop discharge head 34 and a liquid feeding tube 46 for sending the liquid to the liquid drop discharge head 34 from the liquid feeding source 45.

The control device 40 is formed of a computer or the like, which stores the positions of the flushing area 41, specifically the X-coordinates of both sides in parallel to the Y-axis, and information about the position of the liquid drop discharge head 34 as described above. In other words, the control device 40 senses and stores the positions (X-coordinates) of the liquid drop discharge head 34 on the guide rails 33*d* and 33*d* and the positions (X-coordinates) of the separate nozzles. In addition, according to these memories, the control device 40 controls the separate nozzles to perform the normal discharge operation and the flushing operation, and the microvibration operation, which will be described later.

Here, the specific control for the flushing operation by the control device 40 will be described. In the invention, control is conducted by several patterns, but the control is roughly divided into two manners below. In addition, in the following controls, the liquid drop discharge head 34 is rotated and disposed at a desired angle so that the nozzle rows are oblique, and the pitch between the nozzles is formed to be a desired virtual pitch.

The first control is the scheme that the liquid drop discharge head 34 is allowed to perform the flushing operation inside the flushing area 41 while moving the liquid drop discharge head 34 and at least one nozzle reaching the position outside the flushing area 41 is sensed to stop the flushing operation by the entire nozzles.

The second control is the scheme that the liquid drop discharge head 34 is allowed to perform the flushing operation inside the flushing area 41 while moving the liquid drop discharge head 34 and when a nozzle reaches the position outside the flushing area 41, the nozzle to protrude from the flushing area 41 is separately allowed to stop the flushing operation.

Figure 3:
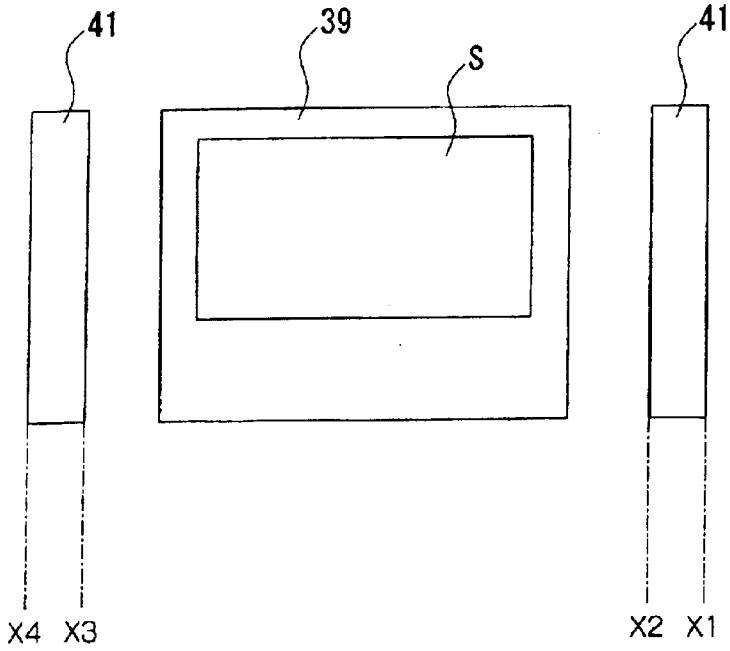
FIG. 3 is a plan view for illustrating the positional relationship between a stage and flushing areas.

More specifically, in these schemes, the positions of both sides of the flushing area 41 are first stored as coordinates in the X-axes that are the direction of moving the liquid drop discharge head 34. At this time, as shown in FIG. 3, when the flushing area 41 is placed on both sides of the stage 39 (substrate S), store X2 and X3 on the stage 39 (substrate S) side, which are the inner X-coordinate, and further store X1 and X4 to be the outer sides.

Figure 4A:
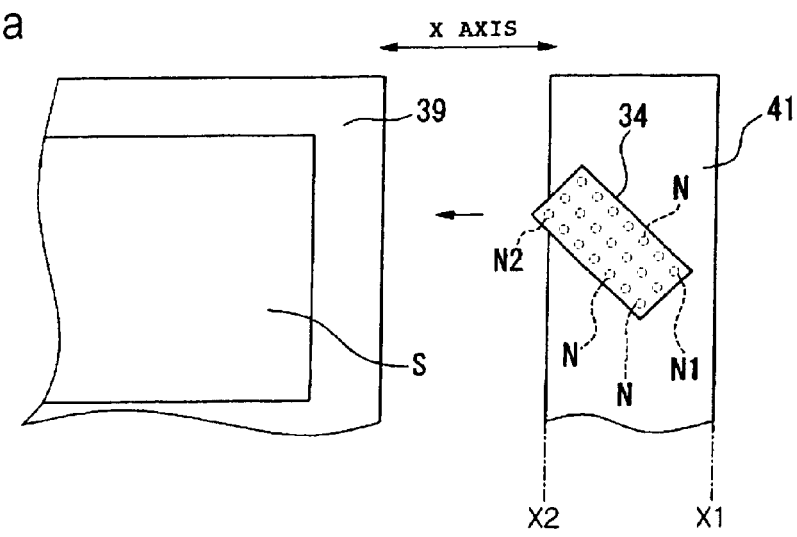
FIGS. 4(*a*) and (*b*) are plan views for illustrating the positional relationship between the flushing area and the liquid drop discharge head.
Figure 4B:
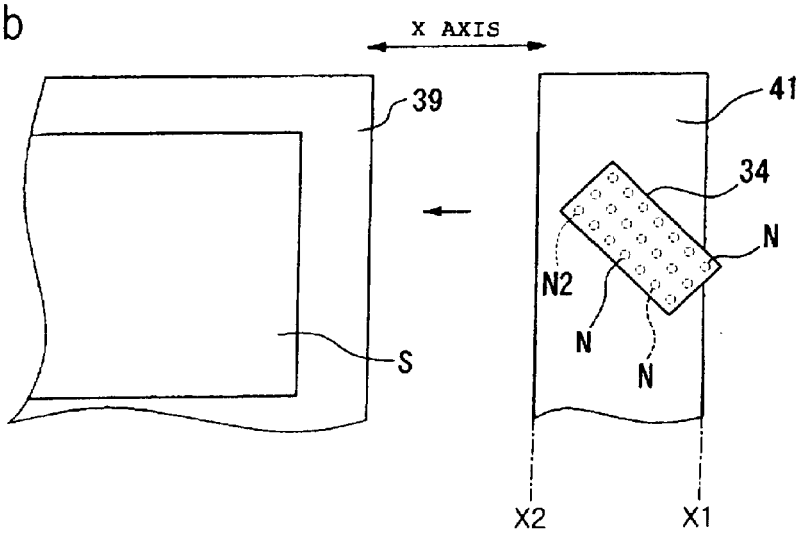

Then, in the first scheme, the nozzles positioned at the outermost of the liquid drop discharge head 34, that is, as shown in FIG. 4(*a*), the positions of the nozzles N1 and N2 at the corner parts to be the outermost positions of the liquid drop discharge head 34 in the X-axis direction are stored, the head is disposed obliquely toward the X-axis direction to be the direction of moving the liquid drop discharge head 34. Additionally, for example, as shown in FIG. 4(*a*), in the case where the liquid drop discharge head 34 is moved from the flushing area 41 side to the stage 39 side when the nozzles N1 and N2 reach the positions outside the predetermined flushing area 41 by moving the liquid drop discharge head 34, the flushing operation by the entire nozzles N is stopped when the nozzle N2 reaches X2 to be the coordinate inside the flushing area 41.

Moreover, it is acceptable that the flushing operation is performed all the while the liquid drop discharge head 34 exists over the flushing area 41. However, particularly when the liquid to be discharged is expensive, the liquid drop discharge head 34 is not allowed to perform the flushing operation when it is moved over the flushing area 41 toward the outside, and it is preferably controlled to perform the flushing operation only when it is moved over the flushing area 41 toward the inside as shown in FIG. 4(*a*).

Accordingly, the nozzles flush right before discharging liquid drops onto the substrate S. Consequently, discharge failures of the nozzles N can be prevented more effectively, and the amount of liquid that is wasted can be minimized.

In addition, in the case where the flushing operation is performed only when the head is moved toward the inside, the start time of the flushing operation is not defined particularly. For example, the liquid drop discharge head 34 is moved over the flushing area 41 toward the outside, it once protrudes from the flushing area 41, and then returns again when the nozzle N1 reaches X1 to be the outer coordinate of the flushing area 41, as shown in FIG. 4(*b*), the entire nozzles N are allowed to perform the flushing operation. Furthermore, in the case where the liquid drop discharge head 34 does not protrude from the flushing area 41 in addition, that is, the entire nozzles N change the moving direction as they exist over the flushing area 41, the entire nozzles N are allowed to perform the flushing operation when they turn back, for example at the turning back point.

On the other hand, in the second scheme, the positions of the entire nozzles N of the liquid drop discharge head 34, which are obliquely disposed, are stored. Then, when the nozzles N reach the positions outside the predetermined flushing area 41 by moving the liquid drop discharge head 34, the nozzles N, that is, the separate nozzles N to protrude from the flushing area 41 are stopped to perform the flushing operation. For example, in the case where the liquid drop discharge head 34 is moved from the flushing area 41 side to the stage 39 side, as shown in FIG. 4(*a*), only the nozzle N2 is controlled to stop the flushing operation when the nozzle N2 reaches X2 to be the inner coordinate of the flushing area 41. Then, the other nozzles N having reached X2 after that are also controlled to sequentially stop the flushing operation.

Moreover, also in the flushing operation in this manner, it is acceptable that the separate nozzles N flush all the while they exist over the flushing area 41. As described above, however, when the liquid to be discharged is expensive, the liquid drop discharge head 34 is not allowed to perform the flushing operation when it is moved over the flushing area 41 toward the outside. It is preferably controlled to perform the flushing operation only when it is moved over the flushing area 41 toward the inside.

Figure 5A:
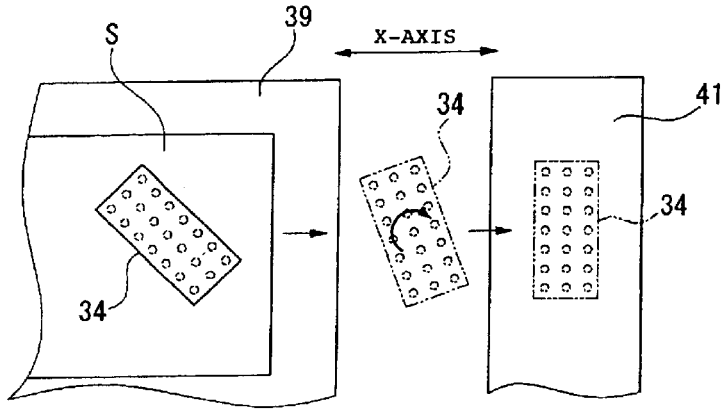
FIGS. 5(*a*) and (*b*) are plan views for illustrating the rotation of the liquid drop discharge head.
Figure 5B:
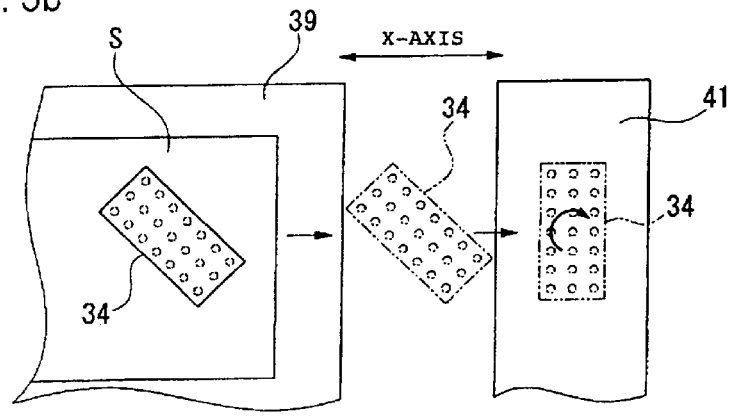

Besides, in these schemes, when the liquid drop discharge head 34 is allowed to flush, it is acceptable that the liquid drop discharge head 34 can be rotated beforehand so that the nozzle rows are orthogonal to the X-axis direction (one direction) to allow flushing in this state. More specifically, as shown in FIG. 5(*a*), when the liquid drop discharge head 34 is allowed to discharge liquid drops onto the stage 39 (substrate S) and then is moved to the flushing area 41 as it is, the control device 40 actuates the motor 44, and the liquid drop discharge head 34 is moved into the normal position, not oblique, as indicated by a chain double-dashed line in FIG. 5(*a*). Consequently, the nozzle rows are positioned corresponding to the Y-axis direction (one direction) over the flushing area 41. Furthermore, when the liquid drop discharge head 34 is rotated in this manner, it is acceptable that the rotation is performed after the head reaches above the flushing area 41 as shown in FIG. 5(*b*).

Moreover, also in the case where the liquid drop discharge head 34 is rotated in flushing, control for flushing can be conducted according to the two controls. Accordingly, when flushing is performed in this manner, the liquid drop discharge head 34 disposed obliquely can prevent a part of the nozzles from protruding from the flushing area 41 to flush.

In addition, when the rotation is performed after the head reaches the flushing area, flushing is performed without affecting discharging liquid drops onto the substrate S. Furthermore, when the second scheme is particularly adopted as the control scheme, the orientation of the nozzle rows of the liquid drop discharge head 34 corresponds to the Y-axis direction (one direction) over the flushing area 41. Thus, the separate nozzles forming the nozzle rows reach at the positions outside the predetermined flushing area 41 simultaneously. Accordingly, even though it is the scheme to control flushing at every nozzle, flushing is substantially controlled by every nozzle row. Accordingly, the flushing operation can be performed without discharging liquid drops outside the flushing area 41, and therefore, simplified control can be intended.

Moreover, also in the case where the liquid drop discharge head 34 is rotated in flushing, the liquid drop discharge head 34 is not allowed to perform the flushing operation when it is moved over the flushing area 41 toward the outside. The head is preferably controlled to perform the flushing operation only when it is moved over the flushing area 41 toward the inside.

Besides, in either of the two control schemes, it is preferable that after the flushing operation, the nozzle having stopped the flushing operation is controlled to perform the microvibration operation before printing.

Here, the microvibration operation is the operation where considerably small voltage can be applied to the piezoelectric element 20 corresponding to each nozzle of the liquid drop discharge head 34, and thereby the diaphragm 13 is vibrated slightly to apply microvibrations to the liquid material inside the spaces 15 shown in FIGS. 2(*a*) and (*b*) and an increase in viscosity of the liquid material is suppressed without discharging liquid drops.

Figure 6:
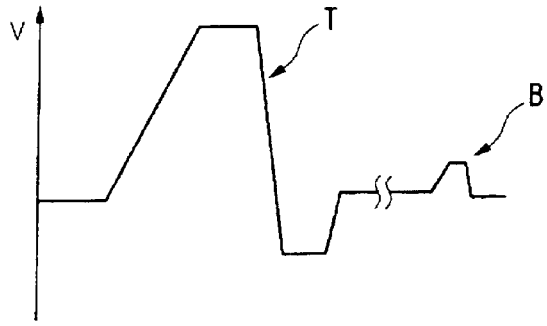
FIG. 6 is a diagram depicting the waveform of the applied voltage to a piezoelectric element.

More specifically, a relatively greater voltage indicated by the waveform T shown in FIG. 6 is applied to the piezoelectric element 20 in discharging liquid drops onto the substrate S and flushing, whereas a small voltage indicated by the waveform B shown in FIG. 6 is applied in the microvibration operation. As described above, only microvibrations are applied to the liquid material without discharging liquid drops. In addition, the microvibration operation has a first microvibration that is performed right before discharging liquid drops onto the substrate S, a second microvibration that is performed by nozzles not performing the discharge operation while the other nozzles are performing the discharge operation among the nozzles, a third microvibration before the liquid drop discharge head 34 starts up, and a constant microvibration that is performed normally. In the invention, it is preferable that particularly after the flushing operation is performed, the nozzle having stopped the flushing operation is allowed to perform the first microvibration.

Accordingly, an increase in viscosity due to the volatilized solvent contained in the liquid inside the liquid drop discharge head 34 can be prevented more surely.

Next, one example of applying a film deposition method using the driving method of the liquid drop discharge apparatus 30 formed of the configuration to color filter fabrication will be described. In this example, the substrate S is first placed on a predetermined position on the stage 39, and the placed position is inputted to the control device 40. In addition, the control device 40 activates the motor 44 to rotate the liquid drop discharge head 34 at an angle that the pitch between the nozzles has a desired virtual pitch, that is, the pitch P3 between the liquid drops T shown in FIG. 15(*b*) is obtained to dispose the nozzle rows obliquely.

As the substrate S, a transparent substrate having a high light transmittance is used as well as having a moderate mechanical strength. More specifically, a transparent glass substrate, an acrylic glass, a plastic substrate, a plastic film, and surface treated products of these or the like are used.

Figure 7:
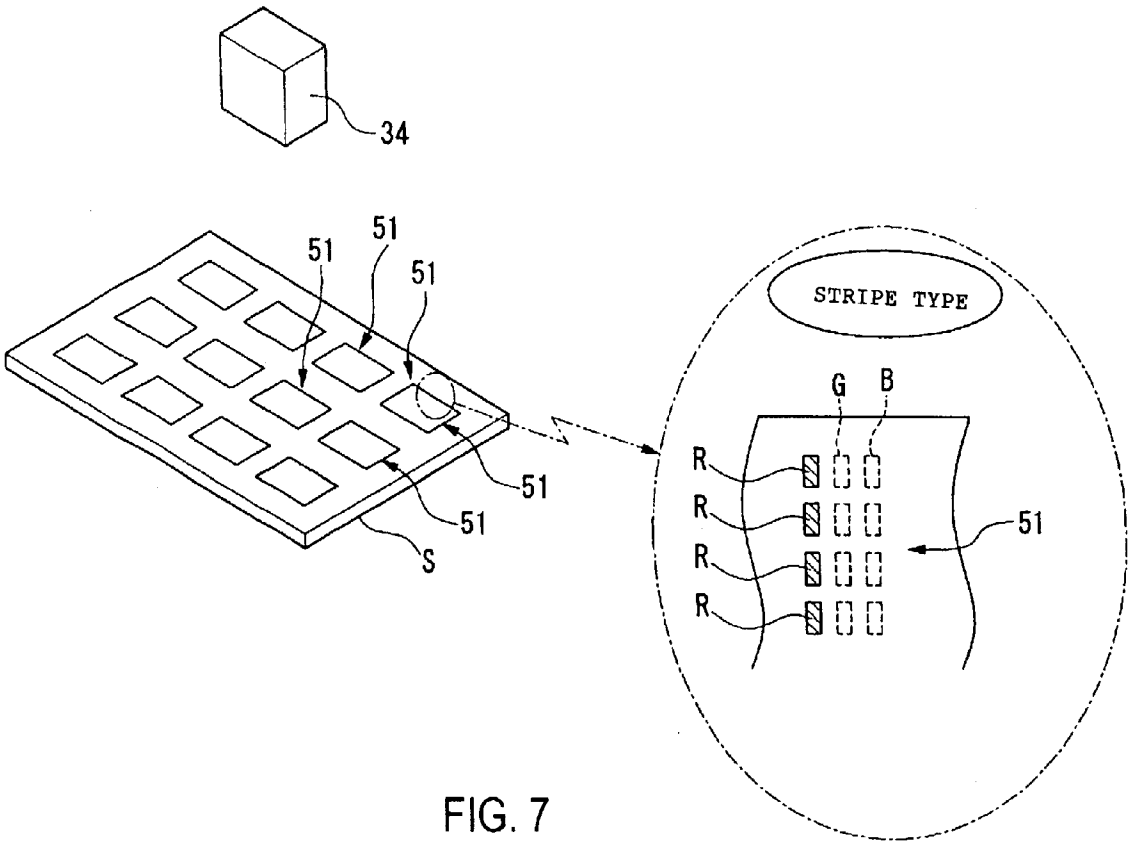
FIG. 7 is a diagram depicting color filter areas on a substrate.
Figure 8A:
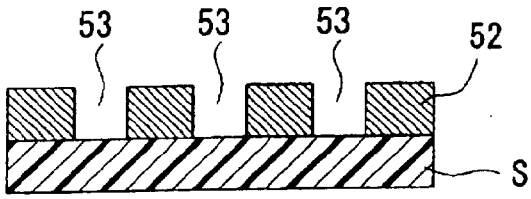
FIGS. 8(*a*) to (*f*) are cross sectional views of the essential part for illustrating the method for forming the color filter areas in order of the process steps.
Figure 8B:
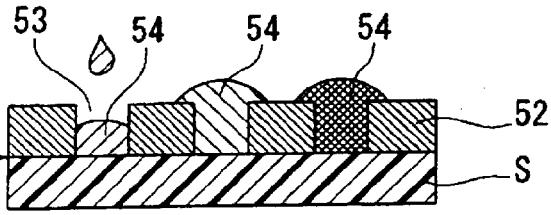
Figure 8C:
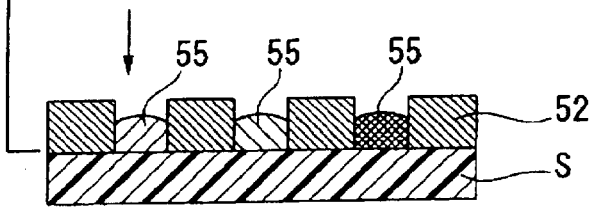
Figure 8D:
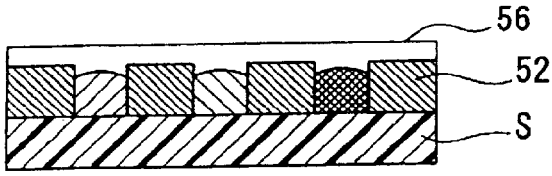
Figure 8E:
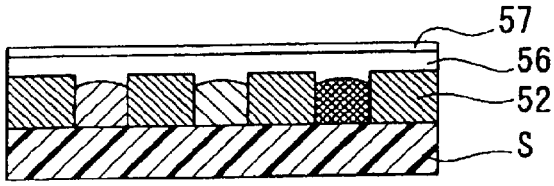
Figure 8F:
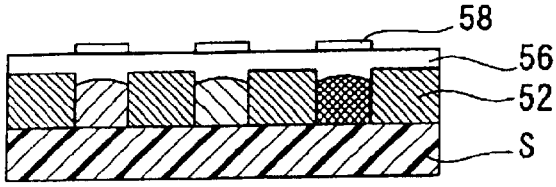

Furthermore, in the example, a plurality of color filter areas 51 can be formed in a matrix on a rectangular substrate S as shown in FIG. 7, in view of increasing productivity. These color filter areas 51 can be used as color filters adapted to liquid crystal display devices by cutting the substrate S afterward. Moreover, as the color filter areas 51, a liquid material for red, a liquid material for green, and a liquid material for blue are formed in predetermined patterns as shown in FIG. 7. In the example, they are formed in a stripe shape traditionally publicly known and disposed. Besides, as the forming patterns, a mosaic shape, a delta shape, or a square shape other than the stripe shape is acceptable.

To form the color filter areas 51, as shown in FIG. 8(*a*), a black matrix 52 can be first formed on one surface of a transparent substrate S. As the method for forming the black matrix 52, a resin with no light transmittance (preferably black color) is coated in a predetermined thickness (about two micrometers, for example) by a method such as spin coating. The minimum display element surrounded by the grid of the black matrix 52, that is, a filter element 53 is formed to have a width of about 30 micrometers in the X-axis direction and a length of about 100 micrometers in the Y-axis direction, for example.

Subsequently, as shown in FIG. 8(*b*), a liquid drop 54 is discharged from the liquid drop discharge head 34 and is fed to the filter element 53. The amount of the liquid drop 54 to be discharged is set to a sufficient amount in consideration of the volume decrease of the liquid material during the heating process.

Here, the discharge of the liquid drop 54 is performed while the liquid drop discharge head 34 is reciprocating in the X-axis direction along the guide rails 33*d* in the head transfer unit 33. At this time, the liquid drop discharge head 34 is moved to the flushing area 41 at every path or every few paths and allowed to flush here as described above. In this case, it is fine to perform flushing by either of the two schemes. In addition, as for whether to perform microvibration before printing, whether to perform flushing after the liquid drop discharge head 34 is once rotated, or timing to perform flushing (to perform flushing only when the head is moved over the flushing area 41 toward the inside), it is fine to select any of them.

When the liquid drops 54 are filled in the entire filter elements 53 on the substrate S in this manner, a heater is used to perform heat treatment so that the substrate S is heated at a predetermined temperature (a temperature of about 70° C.). A solvent contained in the liquid material is evaporated by this heat treatment to reduce the volume of the liquid material. When the volume decrease is excessive, the discharge process and the heating process are repeated until the sufficient film thickness is obtained as the color filter. The solvent contained in the liquid material is evaporated by the processes, only the solid content of the liquid material is left to form a film, and a color material layer 55 is formed, as shown in FIG. 8(*c*).

Then, to planarize the substrate S and protect the color material layer 55, a protection film 56 is formed over the substrate S, covering the color material layer 55 and the black matrix 52, as shown in FIG. 8(*d*). In forming the protection film 56, methods, such as a spin coating method, a roll coating method and a ripping method can be adopted. However, it can be formed by using the liquid drop discharge apparatus 30 shown in FIG. 1, as similar to forming the color material layer 55.

Subsequently, as shown in FIG. 8(*e*), a transparent conductive film 57 is formed over throughout the surface of the protection film 56 by a sputtering method and a vacuum evaporation method. After that, the transparent conductive film 57 is patterned to pattern a pixel electrode 58 corresponding to the filter element 53. Furthermore, when TFTs (Thin Film Transistor) are used to drive a liquid crystal display panel, this patterning is not needed.

In fabricating the color filter by the liquid drop discharge apparatus 30, the flushing operation is particularly preformed while moving the liquid drop discharge head 34. Therefore, productivity can be prevented from being impaired by this flushing.

Moreover, the control device 40 is configured in which the entire nozzles or the separate nozzles to protrude are allowed to stop the flushing operation when the nozzles reach the position outside the flushing area 41. Therefore, the adverse effect on film deposition and patterning and the contamination of the apparatus due to the nozzles protruding from the flushing area 41 to flush can be prevented. Besides, the adverse effect on film deposition and patterning is prevented in this manner, and thus the color filters 55 can be fabricated superiorly with excellent productivity.

Figure 9:
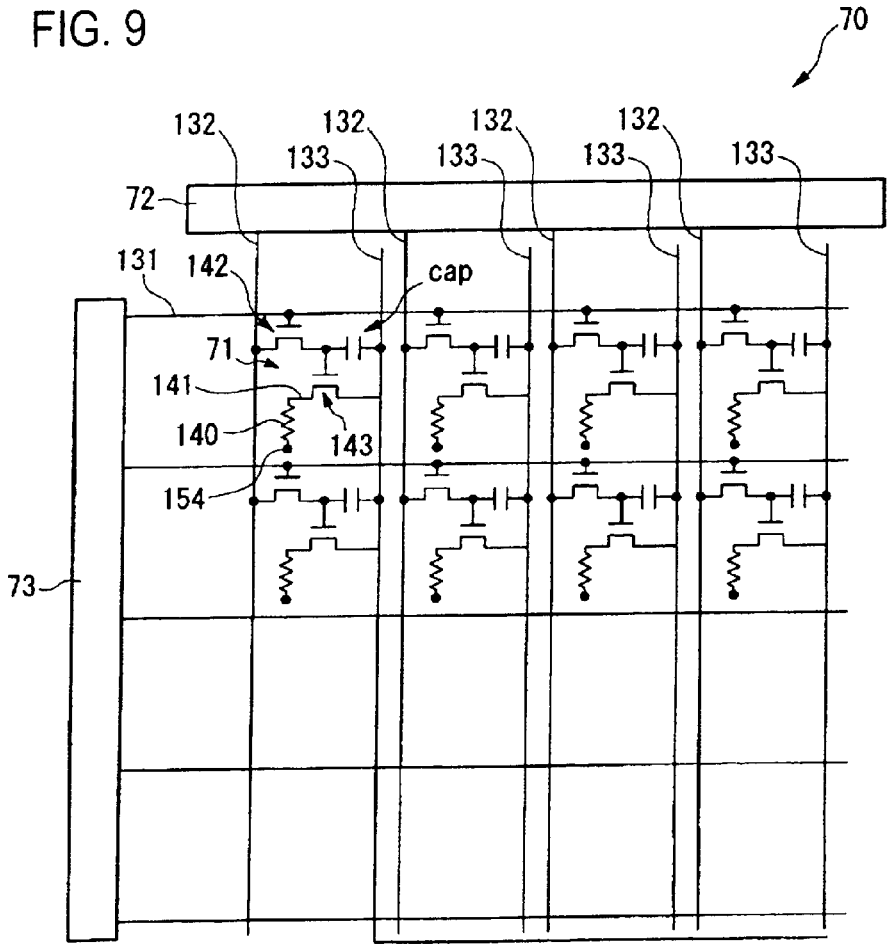
FIG. 9 is a circuit diagram depicting one example of an electroluminescent display provided with an organic electroluminescent diode.
Figure 10:
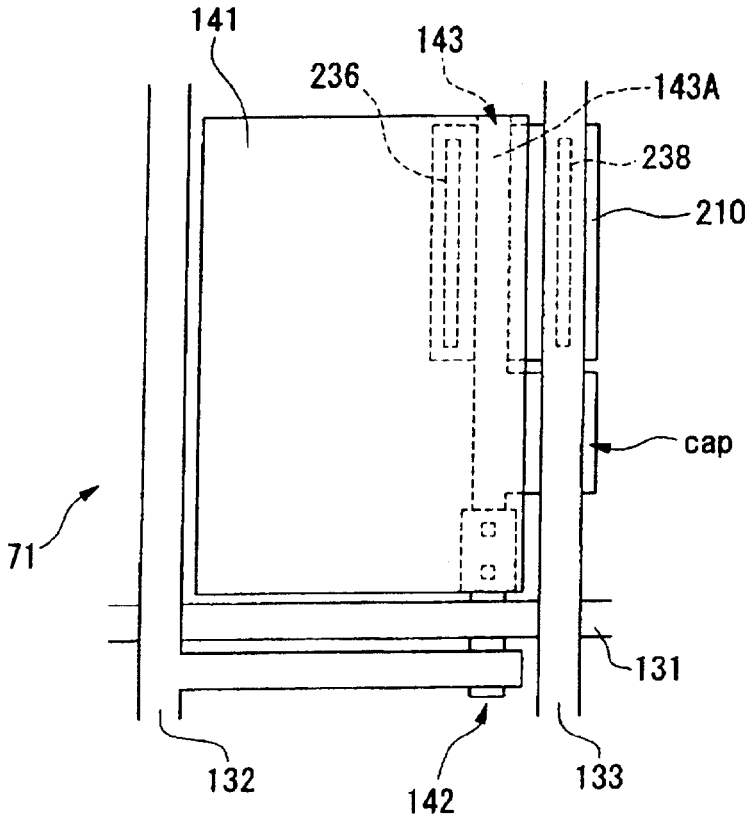
FIG. 10 is an enlarged plan view depicting the plan structure of the pixel part of the electroluminescent display shown in FIG. 9.
Figure 11A:
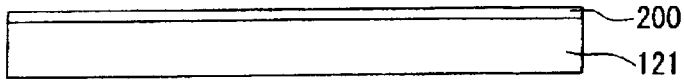
FIGS. 11(*a*) to (*e*) are cross sectional views of the essential part for illustrating a method for fabricating the organic electroluminescent diode in order of the process steps.
Figure 11B:
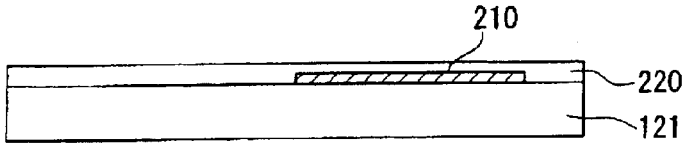
Figure 11C:
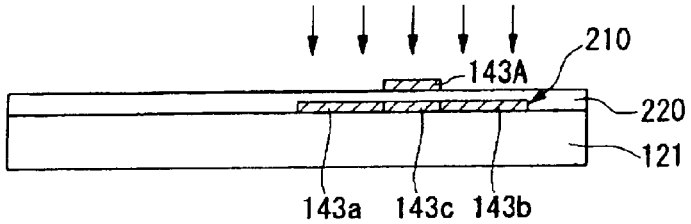
Figure 11D:
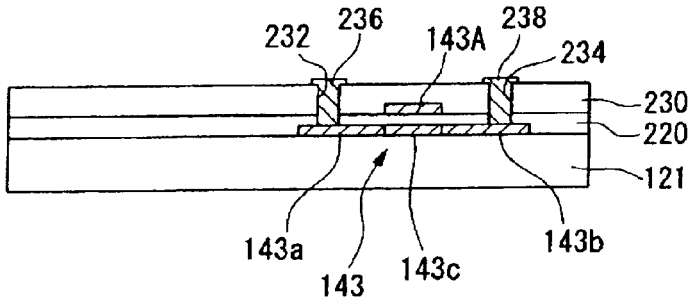
Figure 11E:
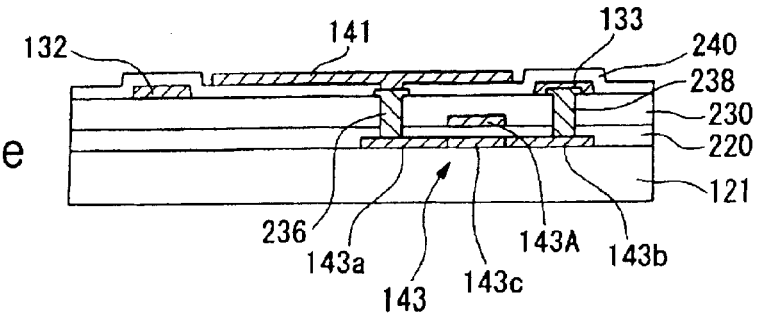
Figure 12A:
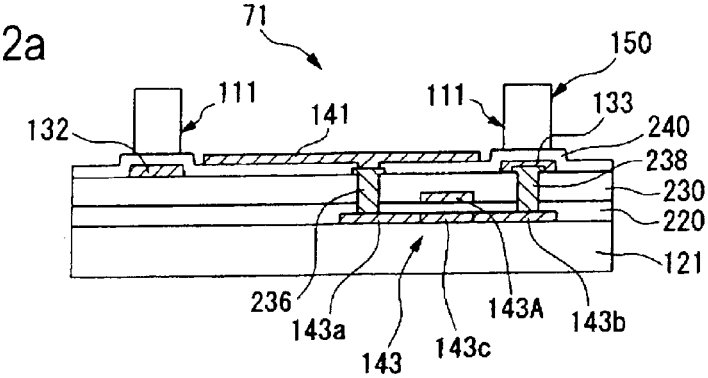
FIGS. 12(*a*) to (*c*) are cross sectional views of the essential part for illustrating the process steps following FIG. 3 in sequence.
Figure 12A:
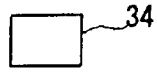
Figure 12A:
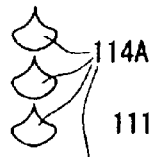
Figure 12B:
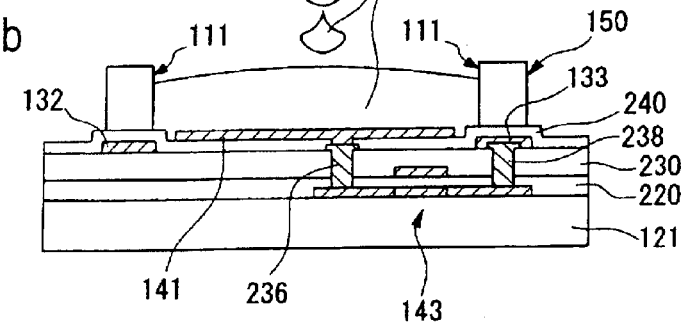
Figure 12C:
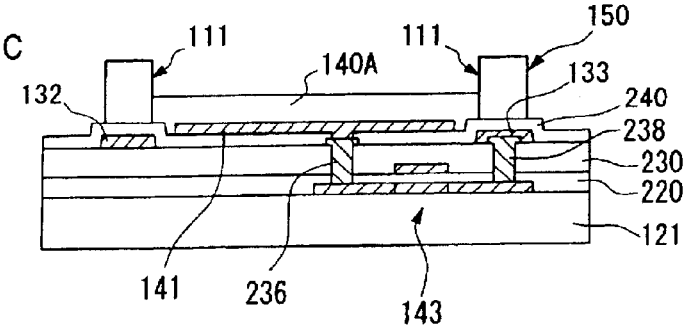

In addition, the film deposition method using the driving method of the liquid drop discharge apparatus 30 of the invention can be applied to forming a thin film to be a component of an organic electroluminescent diode as well. FIGS. 9 and 10 are diagrams for illustrating the schematic configuration of one example of an electroluminescent display having this organic electroluminescent diode. In these drawings, a sign 70 denotes an electroluminescent display.

As shown in FIG. 9, a circuit diagram, the electroluminescent display 70 has a plurality of scanning lines 131, a plurality of signal lines 132 extending in the direction crossing the scanning lines 131, and a plurality of common feeder lines 133 extending in the direction in parallel to the signal lines 132 on a transparent display substrate. The display is configured in which a pixel (pixel area) 71 is disposed at every intersection of the scanning lines 131 and the signal lines 132.

For the signal lines 132, a data side drive circuit 72 having a shift register, a level shifter, a video line and an analog switch is disposed.

In the meantime, for the scanning lines 131, a scan side drive circuit 73 having a shift register and a level shifter is disposed. In addition, in the separate pixel areas 71, a switching thin film transistor 142 that a scan signal is fed to a gate electrode through the scanning line 131, a retention capacity cap for holding a pixel signal fed from the signal line 132 through the switching thin film transistor 142, a current thin film transistor 143 that the pixel signal held by the retention capacity cap is fed to a gate electrode, a pixel electrode 141 into which a drive current flows from the common feeder line 133 when electrically connected to the common feeder line 133 through the current thin film transistor 143, and an emission part 140 sandwiched between the pixel electrode 141 and a reflecting electrode 154 are disposed.

According to this configuration, when the scanning line 131 is activated to turn on the switching thin film transistor 142, the potential of the signal line 132 is held in the retention capacity cap to determine the on-off state of the current thin film transistor 143, depending on the state of the retention capacity cap. Then, a current is carried from the common feeder line 133 to the pixel electrode 141 through the channel of the current thin film transistor 143, and the current is carried to the reflecting electrode 154 through the emission part 140. Therefore, the emission part 140 emits light depending on the amount of the current carried through.

Here, as shown in the FIG. 10, which is an enlarged plan view of eliminating the reflecting electrode and the organic electroluminescent diode, the plan structure of each of the pixels 71 has a plane where the four sides of the rectangular pixel electrode 141 are surrounded by the signal line 132, the common feeder line 133, the scanning line 131, and a scanning line for the other pixel electrode not shown.

Next, a method for fabricating an organic electroluminescent diode disposed in the electroluminescent display 70 will be described with reference to FIGS. 11 to 13. In addition, in FIGS. 11 to 13, only a single pixel 71 is shown in the drawings for simplifying the description.

First, a substrate is prepared. Here, the organic electroluminescent diode can be configured to emit the light emitted from a light emitting layer, which will be described later, from the substrate, or to emit the light from the side opposite to the substrate. In the case of the configuration to emit the light from the substrate, transparent or semitransparent materials such as glass, silica and resins are used as materials for the substrate. Particularly, glass is preferably used.

In addition, it is acceptable that the substrate is disposed with a color filter film, a color conversion film containing a fluorescent material, or a dielectric reflector to control emission color.

Furthermore, in the case of the configuration to emit the light from the opposite side of the substrate, it can be acceptable for the substrate to be opaque. In that case, ceramics, such as alumina, products with electric insulating treatment in a metal sheet, such as stainless steel with surface oxidation or the like, thermosetting resins, and thermoplastic resins can be used.

In the example, as the substrate, a transparent substrate 121 made of soda glass or the like is prepared as shown in FIG. 11(*a*). Then, over this, TEOS (tetraethoxysilan) and oxygen gas are used as raw materials to deposit a base protection film (not shown) made of a silicon oxide film having a thickness of about 200 to 500 nm by plasma CVD as necessary.

Subsequently, the temperature of the transparent substrate 121 is set to about 350° C. to deposit a semiconductor film 200 made of an amorphous silicon film having a thickness of about 30 to 70 nm over the surface of the base protection film by plasma CVD. Then, the semiconductor film 200 undergoes the crystallization process, such as laser annealing or solid phase epitaxy to crystallize the semiconductor film 200 into a polysilicon film. In laser annealing, a line beam of excimer laser with a long dimension of 400 mm is used, for example, and the output intensity is set to 200 $mJ/cm^2$, for example. As the line beam, the line beam is scanned so that the portion corresponding to 90 of the peak value of the laser intensity in the short dimension is overlaid with each area.

Subsequently, as shown in FIG. 11(*b*), a semiconductor film (polysilicon film) 200 is patterned to form a semiconductor film 210 in an island shape. Over the surface, a gate insulating film 220 made of a silicon oxide film or a nitride film having a thickness of about 60 to 150 nm is deposited by plasma CVD as TEOS and oxide gas are used as raw materials. Furthermore, the semiconductor film 210 is to be the channel region and the source/drain region of the current thin film transistor 143 shown in FIG. 10, but a semiconductor film to be the channel region and the source/drain region of the switching thin film transistor 142 is formed as well in the different position of the cross section. More specifically, in the fabrication process shown in FIGS. 11 to 13, two kinds of the transistors 142 and 143 are formed simultaneously, but they are formed in the same procedures. Thus, as for the transistor, only the current thin film transistor 143 will be described in the following description, and the description of the switching thin film transistor 142 will be omitted.

Then, as shown in FIG. 11(*c*), a conductive film made of a metal film, such as aluminium, tantalum, molybdenum, titanium or tungsten, is formed by a sputtering method, and then it is patterned to form a gate electrode 143A.

Subsequently, phosphorus ions of high concentration are implanted in this state, and source/drain regions 143*a* and 143*b* are formed in the semiconductor film 210 in self alignment with respect to the gate electrode 143A. Additionally, the portion where the impurity was not implanted becomes a channel region 143*c*.

Then, as shown in FIG. 11(*d*), an interlayer dielectric 230 is formed, and then contact holes 232 and 234 are formed. Interconnect electrodes 236 and 238 are buried in the contact holes 232 and 234.

Subsequently, as shown in FIG. 11(*e*), the signal line 132, the common feeder line 133, and a scanning line (not shown in FIG. 11) are formed over the interlayer dielectric 230. Here, it is acceptable to form the interconnect electrode 238 and the wiring lines by the same process. At this time, the interconnect electrode 236 is to be formed of an ITO film described later.

Then, an interlayer dielectric 240 is formed so as to cover the top face of the separate wiring lines, a contact hole (not shown) is formed at the position corresponding to the interconnect electrode 236, and an ITO film is deposited so as to be buried in the contact hole. Furthermore, the ITO film is patterned to form the pixel electrode 141 to be electrically connected to the source/drain region 143*a* at a predetermined position surrounded by the signal line 132, the common feeder line 133, and the scanning line (not shown). Here, the portion surrounded by the signal line 132, the common feeder line 133 and the scanning line (not shown) is the place to form a hole injection layer and a light emitting layer described later.

Subsequently, as shown in FIG. 12(*a*), barrier ribs 150 are formed so as to surround the forming place. The barrier rib 150 functions as a partition member, which is preferably formed of an insulating organic material such as polyimide. The film thickness of the barrier rib 150 is formed to have a height of one to two micrometers, for example. Moreover, the barrier rib 150 preferably shows water repellency to the liquid discharged from the liquid drop discharge head 34. In order to allow the barrier rib 150 to express water repellency, a method is adopted, for example, in which the surface of the barrier rib 150 undergoes surface treatment with a fluorine compound. As the fluorine compound, $CF_4$, $SF_5$ and $CHF_3$, for example, cam be used. As the surface treatment, plasma processing and UV irradiation, for example, can be used.

Then, according to the configuration, the place to form the hole injection layer and the light emitting layer, that is, a step 111 having a sufficient height is formed between the position to coat the forming materials and the surrounding barriers rib 150.

Subsequently, as shown in FIG. 12(*b*), the forming material of the hole injection layer is selectively applied from the liquid drop discharge head 34 onto the coating position surrounded by the barrier ribs 150, that is, inside the barrier ribs 150, in the state that the top face of the substrate 121 is directed upward.

Here, the discharge of the forming material of the hole injection layer is conducted in which the liquid drop discharge head 34 is reciprocated along the guide rails 33*d* and 33*d* in the head transfer unit 33 in the X-axis direction. At this time, the liquid drop discharge head 34 is moved to the flushing area 41 at every path or at every few paths, and then it is allowed to flush here, as described above. In this case, it is fine to flush by either of the two schemes as similar to the previous color filter fabrication. On whether to perform microvibration before printing, whether to perform flushing after the liquid drop discharge head 34 is once rotated, and timing to perform flushing (whether to perform flushing only when the head is moved over the flushing area 41 toward the inside), it is acceptable to select any of them.

As the forming materials of the hole injection layer, poly(p-phenylene vinylene), which a polymer precursor is polytetrahydrothiophenylphenylene, 1,1-bis-(4-N,N-ditolylaminophenyl)cyclohexane, and tris(8-hydroxyquinolinol) alminium can be used.

At this time, a liquid forming material 114A tries to spread in the horizontal direction because of high flowability. However, the barrier ribs 150 are formed as surrounding the coated place, and thus the forming material 114A is prevented from spreading outside the barrier ribs 150.

Then, as shown in FIG. 12(*c*), the solvent contained in the liquid precursor 114A is evaporated by heating or light irradiation to form a solid hole injection layer 140A on the pixel electrode 141.

Figure 13A:
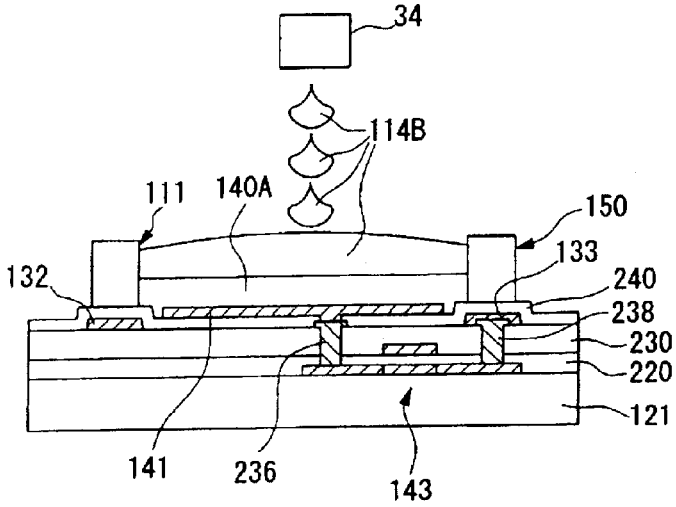
FIGS. 13(*a*) to (*c*) are cross sectional views of the essential part for illustrating the process steps following FIGS. 4(*a*) and (*b*) in sequence.
Figure 13B:
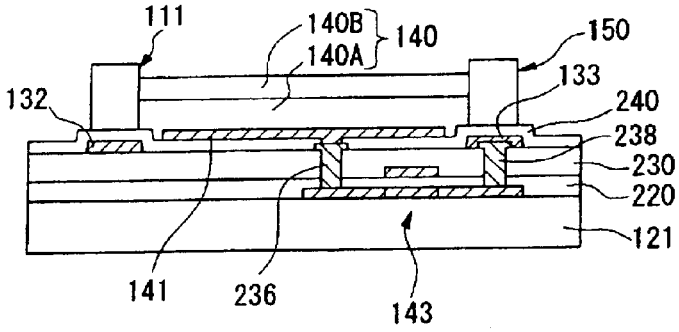
Figure 13C:
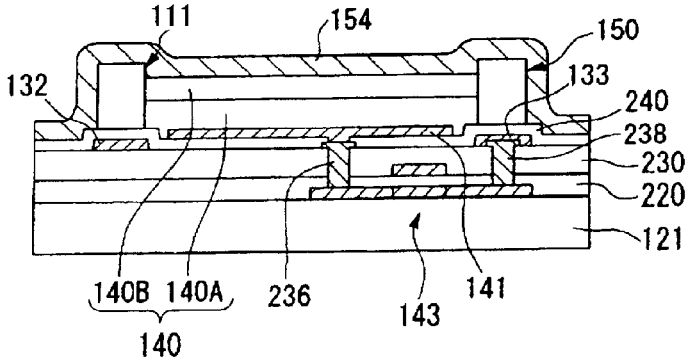

Subsequently, as shown in FIG. 13(*a*), a forming material (luminescent material) 114B of the light emitting layer can be selectively applied onto the hole injection layer 140A inside the barrier ribs 150 as the liquid material from the liquid drop discharge head 34, in the state that the top face of the substrate 121 is directed upward. Also, in the discharge of the forming material of the light emitting layer, the liquid drop discharge head 34 is moved to the flushing area 41 at every path or at every few paths, and is allowed to flush here as described above.

As the forming materials of the light emitting layer, the materials containing a precursor of a conjugated polymer organic compound and a fluorescent dye for changing the light emitting characteristics of the light emitting layer can preferably be used.

The precursor of the conjugated polymer organic compound is those that are discharged from the liquid drop discharge head 34 with the fluorescent dye to be formed to the thin film and then heated and cured as expressed by Formula (I) below, for example, to produce the light emitting layer to be a conjugated polymer organic electroluminescent layer. For example, in the case of sulfonium salt of a precursor, it undergoes heat treatment, and a sulfonium group is eliminated to form a conjugated polymer-organic compound.

(I)

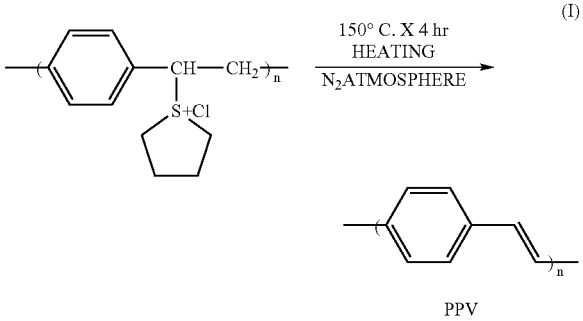

This conjugated polymer organic compound is a solid and has strong fluorescence, which can form a uniform, solid super thin film. It has excellent forming properties and high adhesion to an ITO electrode as well. Moreover, the precursor of the compound forms a strong conjugated polymer film after cured. Therefore, a precursor solution can be adjusted to have a desired viscosity applicable to the film deposition method using the liquid drop discharge head before heated and cured, the method will be described later, and film deposition can be conducted simply for a short time under the optimum conditions.

As this precursor, the precursors of PPV (poly(p-phenylene vinylene) or its derivatives are preferable. The precursors of PPV or its derivatives are soluble in organic solvents and polymerized, and thus a thin film of optically high quality can be obtained. Moreover, PPV has strong fluorescence and is a conductive polymer in which double bonded π-electrons are nonlocalized on a polymeric chain, and thus an organic electroluminescent diode of high performance can be obtained.

As these precursors of PPV or its derivatives, PPV (poly (para-phenylene vinylene)) precursor, MO-PPV (poly(2,5-dimetoxy-1,4-phenylene vinylene)) precursor, CN-PPV (poly(2,5-bis(hexyloxi-1,4-phenylene-(1-cyanovinylene))) precursor, MEH-PPV (poly[2-mehoxy-5-(2'-ethylhexyloxy)]para-phenylene vinylene) precursor can be used, for example, as expressed in Formula (II).

(II)

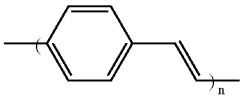

PPV

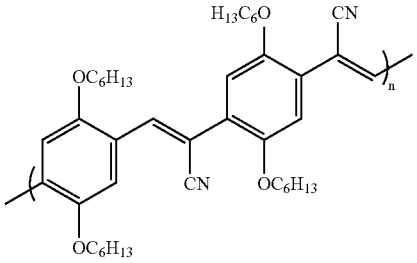

CN-PPV

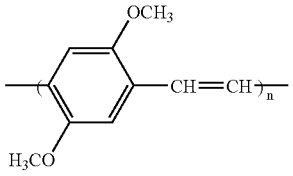

MO-PPV

-continued

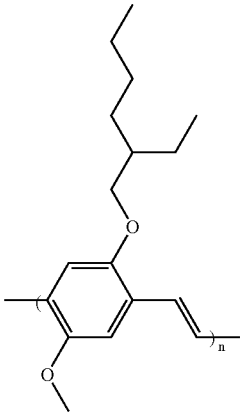

MEH-PPV

The precursors of PPV and the PPV derivatives are water soluble, as described above, and are polymerized by heating after film deposition to form a PPV layer. The content of the precursor represented by the PPV precursor is preferably 0.01 to 10.0 percent by weight of the total composition, more preferably, 0.1 to 5.0 percent by weight. When the loading of the precursors is too short, it is insufficient to form a conjugated polymer film. When it is too much, the viscosity of the composition is increased and it is sometimes unsuitable for highly accurate patterning by the film deposition method using the liquid drop discharge head.

In addition, as the materials for forming the light emitting layer, at least one kind of fluorescent dye is preferably contained. Accordingly, the light emitting characteristics of the light emitting layer can be changed, and it is effective as the scheme to enhance the luminous efficiency of the light emitting layer or to change the peak optical absorption wavelength (emission color), for example. More specifically, the fluorescent dye can be utilized as the dye material to serve the luminescent function itself, not merely as the material for the light emitting layer. For example, most of the energy of the excitons generated in carrier recombination of the conjugated polymer organic compound can be transferred to the fluorescent dye molecules. In this case, light emission is produced only from the fluorescent dye molecules having high fluorescence quantum efficiency. Thus, the current quantum efficiency of the light emitting layer can be increased as well. Therefore, the fluorescent dye is added in the materials for forming the light emitting layer, which allows the fluorescent molecule to obtain the luminescence emission spectrum of the light emitting layer at the same time. Accordingly, it is also effective as the scheme to change the emission color.

In addition, the current quantum efficiency described here is the measure to examine the luminescent performance based on luminescent functions, which is defined by the following equation.

$\eta E$=energy of photons to be released/input electrical energy

Then, the conversion of the peak optical absorption wavelength by doping the fluorescent dye can emit three primary colors, red, blue and green, for example. Consequently, a full color display product can be obtained. Furthermore, the fluorescent dye is dope to improve the luminous efficiency of the electroluminescent diode significantly.

As the fluorescent dye, in the case of forming a light emitting layer emitting red light, Rhodamine or Rhodamine derivatives having red light emission are preferably used. These fluorescent dyes are low weight molecules, and thus they are soluble in aqueous solutions. They have excellent compatibility to PPV, and easily form a uniform, stable light emitting layer. More specifically as the fluorescent dyes, Rhodamine B, Rhodamine B base, Rhodamine 6G, Rhodamine 101 perchlorate are named. The products of mixing two kinds or more of these are acceptable.

Moreover, in the case of forming a light emitting layer emitting green light, Quinacridone having green light emission and its derivatives are preferably used. As similar to the red fluorescent dyes, these fluorescent dyes are low weight molecules, and thus they are soluble in aqueous solutions. They have excellent compatibility to PPV, and they can easily form a light emitting layer.

Besides, in the case of forming a light emitting layer emitting blue light, distylylbiphenyl having blue light emission and its derivatives are preferably used. As similar to the red fluorescent dyes, these fluorescent dyes are low weight molecules, and thus they are soluble in aqueous solution of water mixed with alcohol. They have excellent compatibility to PPV, and they can easily form a light emitting layer.

In addition, as the other fluorescent dyes having blue light emission, Coumarin and its derivatives can be used. As similar to the red fluorescent dyes, these fluorescent dyes are low weight molecules, and thus they are soluble in aqueous solutions. They have excellent compatibility to PPV, and they can easily form a light emitting layer. More specifically as these fluorescent dyes, Coumarin, Coumarin-1, Coumarin-6, Coumarin-7, Coumarin 120, Coumarin 138, Coumarin 152, Coumarin 153, Coumarin 311, Coumarin 314, Coumarin 334, Coumarin 337, and Coumarin 343 may be used.

Furthermore, as the other fluorescent dyes having blue light emission, tetraphenylbutadiene (TPB) and TPB derivatives are named. As similar to the red fluorescent dyes, these fluorescent dyes are low weight molecules, and thus they are soluble in aqueous solutions. They have excellent compatibility to PPV, and they can easily form a light emitting layer.

As for the fluorescent dyes, it is acceptable that only one kind is used in each color, or two kinds or more are mixed for use.

0.5 to 10 percent by weight of the solid portion of the conjugated polymer organic compound precursor of these fluorescent dyes can preferably be added, more preferably 1.0 to 5.0 percent by weight. When the loading of the fluorescent dyes is too much, the weather resistance and the durability of the light emitting layer are hard to maintain, whereas when the loading is too short, the effect of adding the fluorescent dyes cannot be obtained sufficiently.

Moreover, the precursors and the fluorescent dyes are preferably dissolved or dispersed in a polar solvent to form a liquid material, and the liquid material is discharged from the liquid drop discharge head 34. The polar solvent can easily dissolve or uniformly disperse the precursors and the fluorescent dyes. Thus, the solid portion in the light emitting layer forming materials can be prevented from attaching or clogging in the nozzle openings 18 of the liquid drop discharge head 34.

More specifically, as the polar solvent, water, alcohols having compatibility with water such as methanol and ethanol, an organic solvent or an inorganic solvent, such as N,N-dimethylformamide (DMF), N-methylpyrrolidone (NMP), dimethylimidazoline (DMI), and dimethyl sulfoxide (DMSO) are named. Solvents mixing two kinds or more of these solvents are acceptable.

Besides, a wetting agent is preferably added in the forming materials. Accordingly, the forming materials can be effectively prevented from drying and coagulating in the nozzle openings 18 of the liquid drop discharge head 34. As the wetting agent, polyhydric alcohols, such as glycerol and diethylene glycol, can be used. Agents mixing two kinds or more of them are acceptable. As the loading of the wetting agent, it is preferably set to 5 to 20 percent by weight of the total amount of the forming materials.

In addition, it is fine to add other additives and film stabilizing materials. For example, stabilizers, viscosity improvers, antioxidants, pH adjusters, antiseptic agents, resin emulsions, and leveling agents can be used.

When the forming material 114B for the light emitting layer is discharged from the nozzle openings 18 of the liquid drop discharge head 34, the forming material 114A is coated over the hole injection layer 140A inside the barrier ribs 150.

Here, forming the light emitting layer by discharging the forming material 114A is performed in which a forming material of a light emitting layer emitting red light, a forming material of a light emitting layer emitting green light, and a forming material of a light emitting layer emitting blue light are discharge-coated onto the corresponding pixels 71. Furthermore, the pixels 71 corresponding to the separate colors are predetermined to be in a regular arrangement.

The forming materials of the light emitting layers emitting the separate colors are thus discharge-coated, and then the solvent contained in the forming materials 114B of the light emitting layers is evaporated. Therefore, a solid light emitting layer 140B is formed on the hole layer injection layer 140A to obtain an emission part 140 formed of the hole layer injection layer 140A and the light emitting layer 140B, as shown in FIG. 13(*b*). Here, for evaporating the solvent contained in the forming materials 114B of the light emitting layers, heating or pressure reduction is conducted as necessary, but the forming materials of the light emitting layers generally have excellent drying characteristics and dry quickly. Therefore, these processes do not need particularly. Accordingly, the forming materials of the light emitting layers emitting the separate colors are discharge-coated sequentially, and the light emitting layer 140B for the separate colors can be formed in order of coating them.

After that, as shown in FIG. 5(*c*), a reflecting electrode 154 is formed over throughout the front surface of the transparent substrate 121 or formed in a stripe to obtain an organic electroluminescent diode.

Also in fabricating the hole layer injection layer 140A and the light emitting layer 140B to be the components of the organic electroluminescent diode by the liquid drop discharge apparatus 30, the flushing operation is particularly performed while moving the liquid drop discharge head 34. Thus, productivity can be prevented from being impaired by flushing.

In addition, the control device 40 is configured in which the entire nozzles or the separate nozzles to protrude are controlled to stop the flushing operation when the nozzles reach the predetermined position outside flushing area 41. Thus, the adverse effect on film deposition and patterning and the contamination of the apparatus due to the nozzles protruding from the flushing area 41 to flush can be prevented surely. Furthermore, the adverse effect on film deposition and patterning is prevented, and therefore the hole layer injection layer 140A and the light emitting layer 140B can be fabricated superiorly with excellent productivity.

Moreover, the liquid drop discharge apparatus of the invention and the driving method, and the film deposition apparatus having these and the film deposition method can be applicable particularly not only to fabrication of the color filter and the thin films to be the components of the organic electroluminescent diode but also to forming patterning and other various thin films. For example, they are applicable to fabricating a microlens used for a projection screen.

Next, electronic devices of the invention will be described. In the electronic devices of the invention, the components of a device disposed in the electronic devices and thin films to be formed in fabrication are formed by the film deposition method using the driving method of the liquid drop discharge apparatus 30. More specifically, the electronic devices of the invention are formed to have a liquid crystal display device having the color filter and the electroluminescent display having the organic electroluminescent diode as a display device.

Figure 14A:
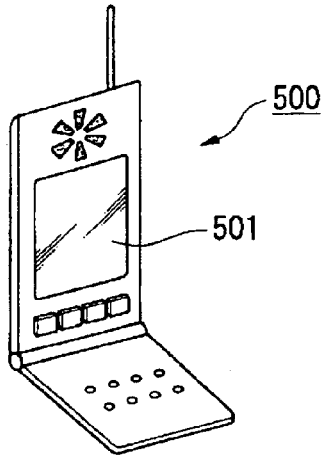
FIG. 14 is a diagram depicting specific examples of electronic devices of the invention, (a) is a perspective view depicting one example of the application to a mobile phone, (b) is a perspective view depicting one example of the application to an information processor, and (c) is a perspective view depicting one example of the application to a wristwatch type electronic device.
Figure 14B:
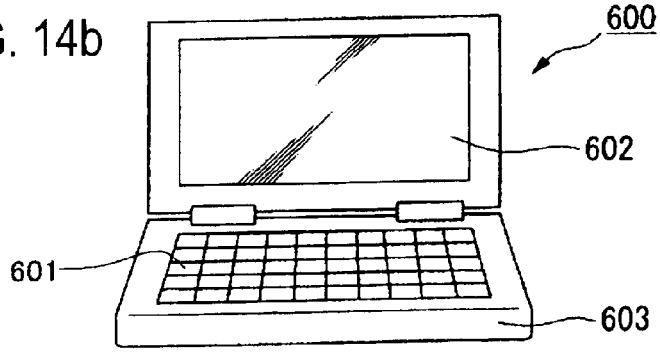
Figure 14C:
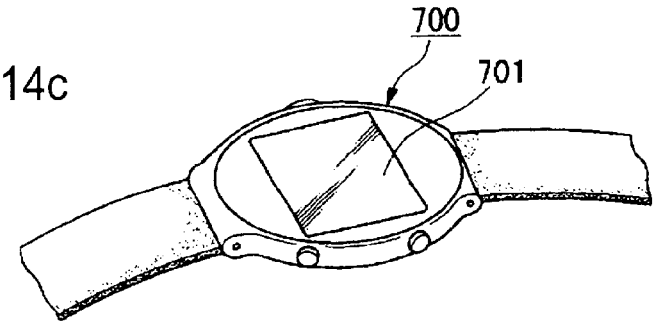

FIG. 14(*a*) is a perspective view depicting one example of a mobile phone. In FIG. 14(*a*), 500 denotes a mobile phone main body, and 501 denotes a display device formed of the liquid crystal display device or the electroluminescent display.

FIG. 14(*b*) is a perspective view depicting one example of a mobile information processor, such as a word processor and a personal computer. In FIG. 14(*b*), 600 denotes an information processor, 601 denotes an input part, such as a keyboard, 603 denotes an information processing main body, and 602 denotes a display device formed of the liquid crystal display device or the electroluminescent display.

FIG. 14(*c*) is a perspective view depicting one example of a wristwatch type electronic device. In FIG. 14(*c*), 700 denotes a display device formed of the liquid crystal display device or the electroluminescent display.

The electronic devices shown in FIGS. 14(*a*) to (*c*) have the display device formed of the liquid crystal display device or the electroluminescent display, and thus they are fabricated superiorly with excellent productivity.

As described above, according to the liquid drop discharge apparatus of the invention, the flushing operation may be performed inside the flushing area while moving the liquid drop discharge head. Therefore, productivity is not impaired by this flushing. In addition, the control unit was configured to stop the flushing operation by the entire nozzles when at least one nozzle reached the position outside the predetermined flushing area. Thus, the adverse effect on film deposition and patterning and the contamination of the apparatus due to the nozzle protruding from the flushing area to flush can be prevented.

According to another liquid drop discharge apparatus of the invention, the flushing operation can be performed inside the flushing area while moving the liquid drop discharge head. Therefore, productivity is not impaired by this flushing. Furthermore, the control unit was configured to stop the flushing operation by a nozzle when the nozzle reached the position outside the predetermined flushing area. Thus, the adverse effect on film deposition and patterning and the contamination of the apparatus due to the nozzle protruding from the flushing area to flush can be prevented.

According to the film deposition apparatus of the invention, it is formed to have the liquid drop discharge apparatus. Therefore, productivity is not impaired by flushing, and the adverse effect on film deposition and the contamination of the apparatus due to the nozzle protruding from the flushing area to flush can be prevented.

According to the driving method of the liquid drop discharge apparatus of the invention, the flushing operation is performed inside the flushing area while moving the liquid drop discharge head. Therefore, productivity is not impaired by this flushing. Moreover, the flushing operation by the entire nozzles is stopped when at least one nozzle reaches the position outside the predetermined flushing area. Thus, the adverse effect on film deposition and patterning and the contamination of the apparatus due to the nozzle protruding from the flushing area to flush can be prevented.

According to another driving method of the liquid drop discharge apparatus of the invention, the flushing operation is performed inside the flushing area while moving the liquid drop discharge head. Therefore, productivity is not impaired by this flushing. Besides, the flushing operation by a nozzle is stopped when the nozzle reaches the position outside the predetermined flushing area. Thus, the adverse effect on film deposition and patterning and the contamination of the apparatus due to the nozzle protruding from the flushing area to flush can be prevented.

According to the film deposition method of the invention, it is formed to have the driving method of the liquid drop discharge apparatus. Therefore, productivity is not impaired by flushing, and the adverse effect on film deposition and the contamination of the apparatus due to the nozzle protruding from the flushing area to flush can be prevented.

According to the method for forming the color filter of the invention, the color filter was formed by the film deposition method. Thus, productivity is not impaired, and the adverse effect on film deposition and the contamination of the apparatus are prevented. Therefore, the color filter can be formed superiorly with excellent productivity.

According to the method for fabricating the organic electroluminescent device of the invention, the thin films to be the components of the organic electroluminescent device were deposited by the deposition method. Therefore, productivity is not impaired, and the adverse effect on film deposition and the contamination of the apparatus are prevented. Thus, the thin films to be the components of the organic electroluminescent diode can be deposited superiorly with excellent productivity.

According to the electronic device of the invention, it is formed to have the device fabricated by using the film deposition method. Thus, the electronic device can be fabricated superiorly with excellent productivity.

What is claimed is:

1. A liquid drop discharge apparatus, comprising:

a liquid drop discharge head disposed above a stage and configured to reciprocate in one direction with respect to a substrate with a plurality of nozzles arranged lengthwise and crosswise that discharge a liquid drop onto the substrate;

a flushing area disposed on at least one side of the substrate on the stage in the direction; and a control unit adapted to control an operation of the liquid drop discharge head, the liquid drop discharge head having rows of the nozzles disposed obliquely toward the direction, in which the control unit controls the liquid drop discharge head to perform a flushing operation inside the flushing area while moving the liquid drop discharge head, and the control unit controls the entire nozzles to stop the flushing operation when at least one nozzle reaches a position outside a predetermined flushing area.

2. The liquid drop discharge apparatus according to claim 1, the control unit controlling the nozzle to stop the flushing operation, and then controlling the nozzle to perform a microvibration operation.

3. The liquid drop discharge apparatus according to claim 1, the flushing area being disposed on both sides of the substrate on the stage in the direction.

4. The liquid drop discharge apparatus according to claim 1, the control unit controlling the liquid drop discharge head to perform the flushing operation only when the head is moved over the flushing area toward an inside, and thereby not allowing the flushing operation when the head is moved over the flushing area toward an outside.

5. The liquid drop discharge apparatus according to claim 1, the liquid drop discharge head being disposed rotatably in its circumferential direction, and its rotation of the liquid drop discharge apparatus being controlled by the control unit, and the control unit controlling the liquid drop discharge head to rotate beforehand so that the rows of the nozzles are orthogonal to the direction when the liquid drop discharge head is moved into the flushing area to flush, and the control unit controlling the head to rotate obliquely again after the entire nozzles stop the flushing operation.

6. The liquid drop discharge apparatus according to claim 5, the operation of rotating the liquid drop discharge head in which the rows of the nozzles are orthogonal to the direction being performed over the flushing area.

7. A film deposition apparatus comprising the liquid drop discharge apparatus according to claim 1.

8. A driving method of a liquid drop discharge apparatus for applying a liquid drop onto a substrate placed on a stage, the liquid drop discharge apparatus including a liquid drop discharge head disposed above a stage and configured to reciprocate in one direction with respect to a substrate with a plurality of nozzles arranged lengthwise and crosswise that discharges a liquid drop onto the substrate, a flushing area disposed on at least one side of the substrate on the stage in the direction, the liquid drop discharge head having rows of the nozzles disposed obliquely toward the direction, the method comprising:

flushing in which liquid drop discharge head is allowed to perform a flushing operation inside the flushing area while moving the liquid drop discharge head; and after that, the entire nozzles are allowed to stop the flushing operation when at least one nozzle reaches a position outside a predetermined flushing area.

9. The driving method of the liquid drop discharge apparatus according to claim 8, the nozzle being allowed to stop the flushing operation, and then the nozzle being allowed to perform a microvibration operation.

10. The driving method of the liquid drop discharge apparatus according to claim 8, the flushing area being disposed on both sides of the substrate on the stage in the direction.

11. The driving method of the liquid drop discharge apparatus according to claim 8, the liquid drop discharge head being allowed to perform the flushing operation only when it is moved over the flushing area toward an inside, and thereby not allowing the flushing operation when it is moved over the flushing area toward an outside.

12. The driving method of the liquid drop discharge apparatus according to claim 8, the liquid drop discharge head being disposed rotatably in its circumferential direction, and its rotation being controlled by the control unit, and the control unit controlling the liquid drop discharge head to rotate beforehand so that the rows of the nozzles are orthogonal to the direction when the liquid drop discharge head is moved into the flushing area to flush, and the control unit controlling the liquid drop discharge head to rotate obliquely again after the entire nozzles stop the flushing operation.

13. The driving method of the liquid drop discharge apparatus according to claim 12, the operation of rotating the liquid drop discharge head in which the rows of the nozzles are orthogonal to the direction being performed over the flushing area.

14. A film deposition method comprising the driving method according to claim 8.

15. A method for forming a color filter by the film deposition method according to claim 14.

16. A method for fabricating an organic electroluminescent device comprising:

forming a thin film to be a component of the organic electroluminescent device by the film deposition method according to claim 14.

17. An electronic device comprising a device fabricated by using the film deposition method according to claim 14.

* * * * *